US007343703B2

(12) United States Patent
Giovalle et al.

(10) Patent No.: US 7,343,703 B2
(45) Date of Patent: Mar. 18, 2008

(54) PRESSING IRON HAVING AN IMPROVED CORD GUIDE DEVICE

(75) Inventors: Christian Giovalle, Moidieu Detourbe (FR); Sylvain Maudhuit, Pisieu (FR); Amar Djeroro, Givors (FR)

(73) Assignee: SEB S.A., Ecully (FR)

( * ) Notice: Subject to any disclaimer, the term of this patent is extended or adjusted under 35 U.S.C. 154(b) by 0 days.

(21) Appl. No.: 11/522,891

(22) Filed: Sep. 19, 2006

(65) Prior Publication Data

US 2007/0062078 A1 Mar. 22, 2007

(30) Foreign Application Priority Data

Sep. 19, 2005 (FR) ..... 05 09546

(51) Int. Cl.
*D06F 75/40* (2006.01)
*D06F 79/00* (2006.01)

(52) U.S. Cl. ..... 38/142; 248/51

(58) Field of Classification Search ..... 38/142, 38/88; 248/51, 52; 242/157 R; 439/446, 439/447, 568; 174/663
See application file for complete search history.

(56) References Cited

U.S. PATENT DOCUMENTS 1,516,781 A * 11/1924 Nylen ..... 248/52
2,503,124 A 4/1950 Morton
2,540,575 A * 2/1951 Finizie ..... 439/446
3,030,485 A * 4/1962 Jepson et al. ..... 38/82
4,101,729 A * 7/1978 Balchunas ..... 174/663
4,784,616 A * 11/1988 Zimmermann ..... 439/568
6,770,986 B2 * 8/2004 Nagao et al. ..... 307/326

FOREIGN PATENT DOCUMENTS

DE 93 06 930 U1 8/1993

* cited by examiner

*Primary Examiner*—Ismael Izaguirre
(74) *Attorney, Agent, or Firm*—Browdy and Neimark, PLLC

(57) ABSTRACT

A pressing iron composed of a case provided with an opening and a power cord that extends from the opening, and a cord guide device mounted to the case and disposed in the opening for reinforcing the cord in a region adjacent to the case in order to limit flexural of the cord. The cord guide device includes a body enveloping a portion of the cord and a mobile guide member for permitting the extent of the cord that is reinforced by the cord guide device to be varied. The mobile guide member is supported by the body and is adapted to occupy a folded up position in which the mobile guide member is substantially integrated into the body and a deployed position in which the mobile guide member projects outside of the body.

16 Claims, 3 Drawing Sheets

PRESSING IRON HAVING AN IMPROVED CORD GUIDE DEVICE

BACKGROUND OF THE INVENTION

The present invention relates to a pressing iron having a housing, or case, provided with an opening into which a flexible power cord extends and receiving a cord guide device to limit flexure, or bending, of the cord at the outlet of the housing.

The patent document DE 93 06 930U discloses a pressing iron having a power cord that is reinforced locally by a flexible cord guide device that surrounds the cord adjacent to the housing of the iron. The iron also has a maintenance shank, or rod, pivotally mounted on the heel of the iron and adapted to occupy a deployed position in which the free end of the rod comes to support the cord at a point relatively distant from the cord outlet in order to displace the cord and a folded up position in which the rod is folded up against the heel of the iron. With such a solution, the maintenance rod in the deployed position presents the advantage of extending the cord in order to prevent it from rubbing against the articles being ironed. The possibility of retracting the maintenance rod also presents the advantage of reducing the space occupied by the iron during storage. However, such a maintenance rod is not usable with an iron whose power cord is disposed at a lower position, close to the center of the heel of the iron, and not near the top. In addition, such a maintenance rod presents the drawback of encumbering the heel of the iron when it is in the retracted position, with one result being that it cannot be used with an iron provided with a filling orifice at the rear.

BRIEF SUMMARY OF THE INVENTION

The present invention overcomes these drawbacks by providing a pressing iron having a cord guide device that can guide a relatively long length of the cord, in order to sufficiently extend the cord, and that presents a reduced length in order to limit the space occupied by the iron during storage.

In addition, the cord guide device of an iron according to the present invention itself takes up little space and that can be mounted at different locations of the iron without difficulty.

Thus, the invention provides a pressing iron having a housing, or case, provided with an opening into which a power cord extends, the opening receiving a cord guide device that serves to reinforce the portion of the cord adjacent the housing in order to limit flexure, or bending, of the cord. The cord guide device according to the invention has a body that surrounds, or envelops, the portion of the cord adjacent to the housing of the iron and mobile guide means permitting the cord length over which the cord is maintained to be varied. In particular in accordance with the invention, the mobile guide means are supported by the body that envelops the cord and can occupy a folded up position, in which they are substantially integrated into the body, and a deployed, or extended, position, in which the guide means project outside of the body.

According to one characteristic of the invention, the mobile guide means are displaced by spring means into the deployed position.

This presents the advantage of permitting an automatic deployment of the mobile guide means toward the most appropriate position for ironing, i.e., in which the length of cord guidance is increased.

According to another characteristic of the invention, the cord guide device has locking means permitting the mobile guide means to be maintained in the folded up position, the locking means being associated with an unlocking button.

This characteristic helps to facilitate storage of the iron by assuring that the mobile guide means of the cord guide device will be maintained in the folded up position in which it occupies the least space.

According to another characteristic of the invention, the body of the cord guide device is pivotally mounted on the iron and the unlocking button is actuated automatically when the body is rocked toward the rear.

This characteristic provides assurance of automatic deployment of the mobile guide means upon the first application of a tension force to the cord during ironing.

According to another characteristic of the invention, the mobile guide means are flexible.

This characteristic helps to assure that the cord will not be damaged or weakened by flexure when the guide means are deployed.

According to another characteristic of the invention, the body of the cord guide device has a greater rigidity than do the mobile guide means.

According to another characteristic of the invention, the mobile guide means are movable in translation with respect to the body of the cord guide device.

According to another characteristic of the invention, the mobile guide means are constituted by an extension piece that is displaceable in the body of the cord guide device to form a telescopic cord guide.

According to another characteristic of the invention, the body of the cord guide device and the extension piece are slightly conical.

According to another characteristic of the invention, the cord is an electric power cord.

DETAILED DESCRIPTION OF THE INVENTION

Figure 1:
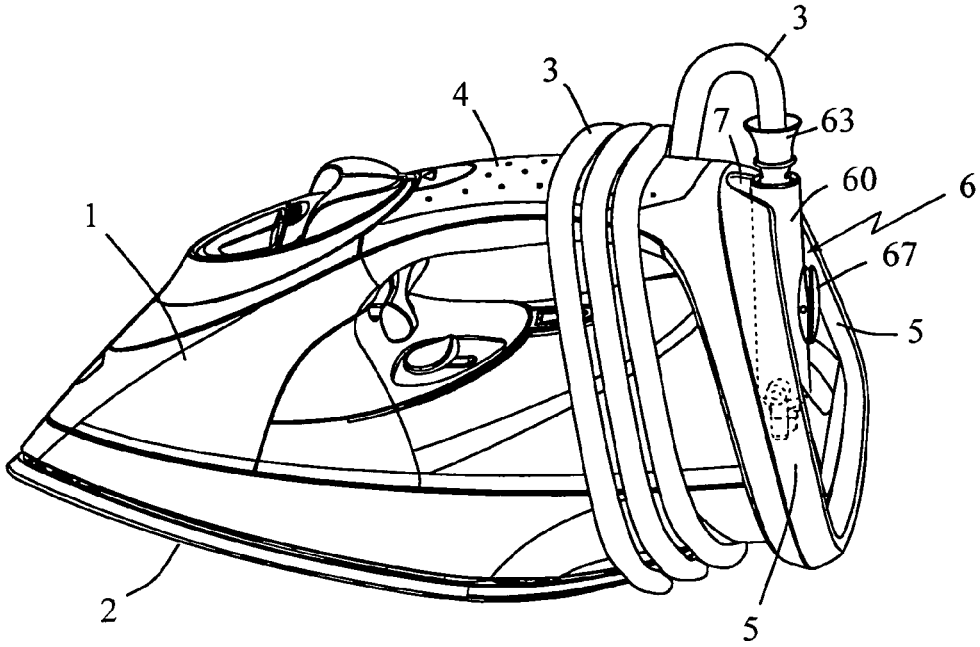
FIG. 1 is a perspective view of a pressing iron having a cord guide device according to one embodiment of the invention, the guide device being in its folded up position.

In the present description and illustrations, only the elements needed for an understanding of the invention will be described and shown. In order to facilitate an understanding of the drawings, the same elements are given the same reference numerals from one figure to another.

Figure 2:
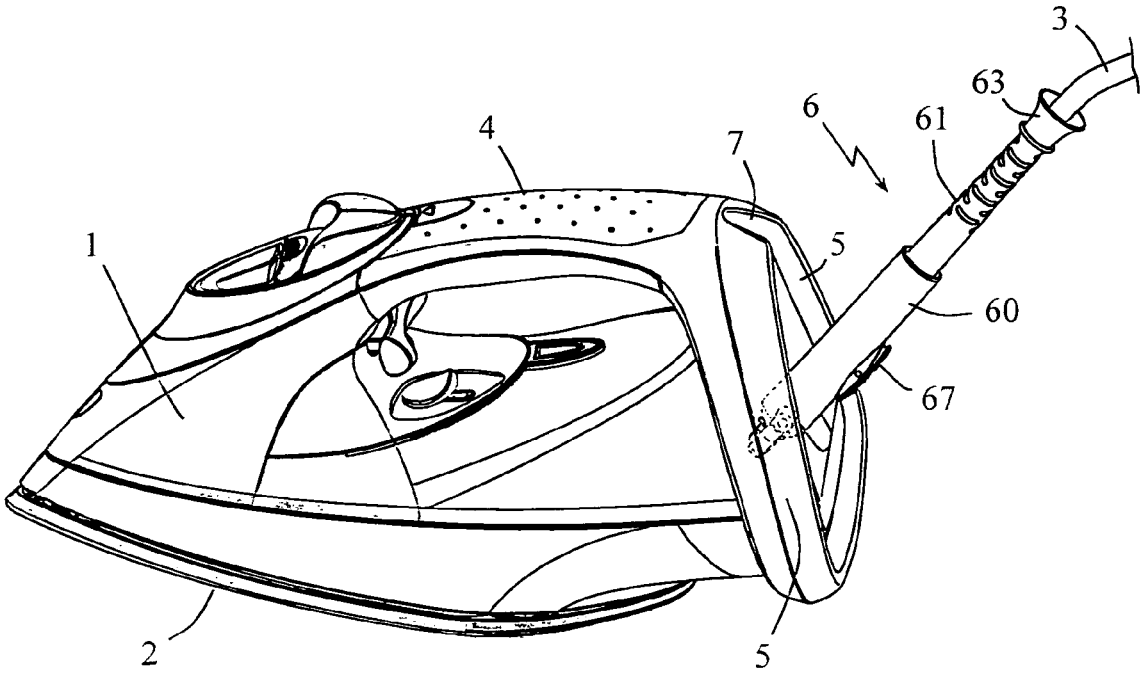
FIG. 2 is a view similar to that of FIG. 1 of the same appliance with the cord guide device deployed, or extended.

FIGS. 1 and 2 show a pressing iron having a plastic housing 1 that carries a soleplate 2 connected to the bottom of housing 1. Soleplate 2 is heated, in a conventional manner, by an electric resistance that receives electric power through a power cord 3. One end of cord 3 is provided with an electric plug (not shown) for connecting the iron to an electric outlet.

As shown in FIG. 1, housing 1 includes a handle 4 that is connected to the rear end of the iron by two arms 5 extending in a diverging manner from handle 4 to the body of the iron so that the resulting structure has a substantially triangular shape. Arms 5 delimit, and enclose, an open space at the rear of the iron, where the iron is also furnished with an opening through which cord 3 enters the interior of housing 1.

More particularly, according to the invention, at the location where the cord extends out of housing 1, there is provided a cord guide device 6 composed of a body 60 that is slightly conical and through which cord 3 passes. Cord guide device 6 also has mobile guide means 61 movable relative to body 60 in order to permit the length, or distance, over which cord 6 is supported by guide device 6 to be varied.

Figure 3:
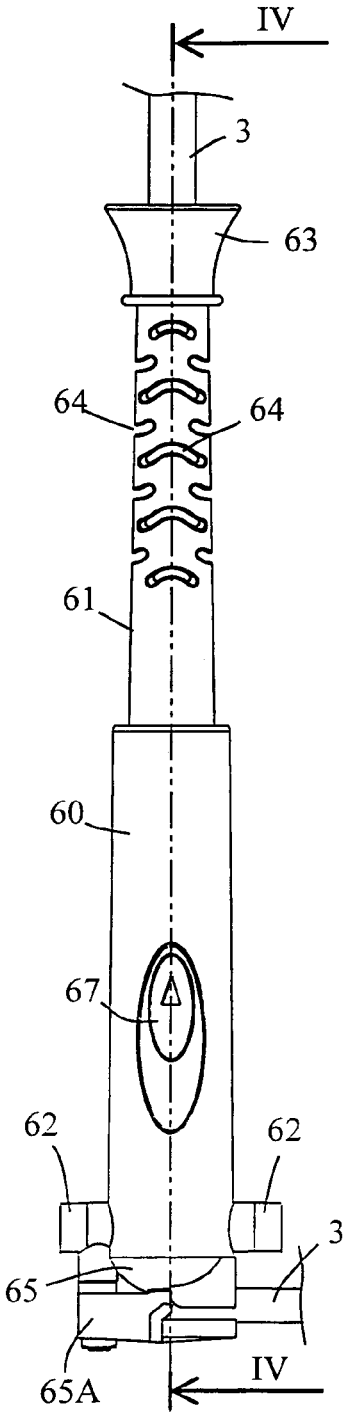
FIG. 3 is a bottom view of the cord guide device of FIG. 1.
Figure 6:
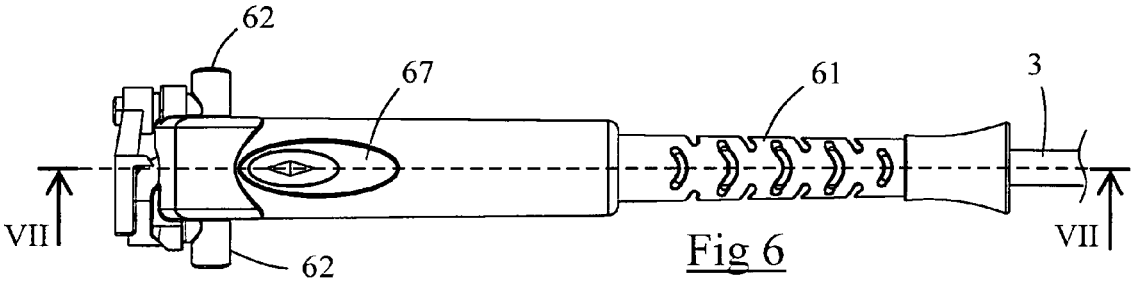
FIG. 6 is a bottom view of the cord guide device of FIG. 5.

In a preferred manner, body 60 is pivotally mounted to housing 1 by a pivot element 62, composed, for example, of two pivot pins, as shown most clearly in FIGS. 3 and 6. Pivot element 62 permits body 60 to pivot about an axis generally perpendicular to the length, or longitudinal direction, of the iron. Housing 1 is provided with a notch 7, at the junction of the two arms 5 with handle 4, in which body 60 can be inserted when brought into a substantially vertical position. The length of body 60 is advantageously close to the distance separating pivot element 62 from the rear end of handle 4 so that the free end of body 60 is found in the extension of handle 4 when body 60 is inserted into notch 7.

The mobile guide means are preferably constituted by an extension piece 61 in the form of a sheath for reinforcing cord 3. Extension piece 61 is slidable at the interior of body 60 through an opening formed in the end of body 60 that is opposite to pivot element 62. Thus, body 60 and extension piece 61 together give device 60 the form of a telescopic cord guide device.

The end of extension piece 61 that is located outside of body 60 includes a protection ferrule, or nozzle, 63 having the form of a trumpet mouthpiece and serving to prevent the cord from being brought into contact with a sharp edge. In an advantageous manner, extension piece 61 is flexible and has a progressive flexibility in order to better distribute strains imposed on cord 3, and thus increase its ability to undergo flexure, the flexibility of the extension piece preferably increasing along the length of the piece in the direction of protection ferrule 63. This progressive flexibility of extension piece 61 is obtained due to a slightly frustoconic form of the extension piece and to the presence of cavities 64 in proximity to the end provided with protection ferrule 63.

By way of example, body 60 is made of a hard plastic, such as a polycarbonate, and the extension piece is molded from a flexible material, such as an elastomer material.

As shown in FIG. 3, the end of body 60 provided with pivot element 62 is closed by a ferrule 65 that includes a flange 65A for immobilizing cord 3, thus assuring that a tension force applied to cord 3 outside of the iron will not have an adverse influence on the electric connections inside housing 1. In other words, flange 65A acts as sort of clamp on a portion of cord 3 that is arranged to extend, within the housing, at right angles to the portion of cord 3 that extends through body 60.

Figure 4A:
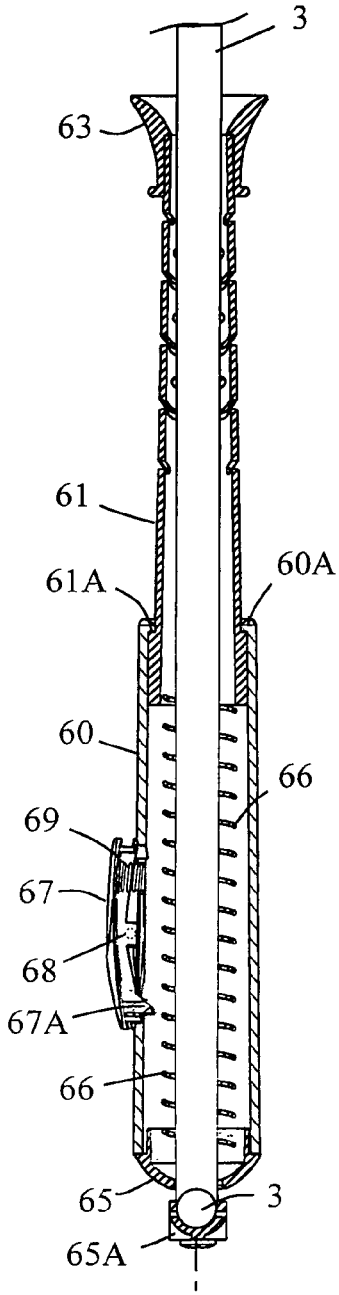
FIGS. 4*a* and 4*b* are cross-sectional views, along line IV-IV of FIG. 3, of the cord guide device of FIG. 3, in respective ones of an extended position and a retracted position.
Figure 4B:
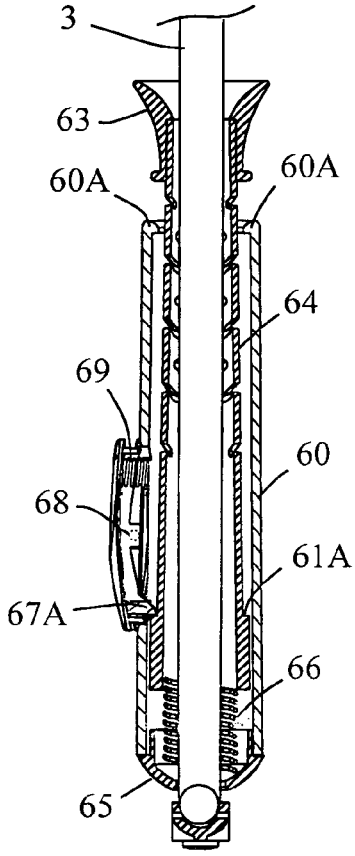

As is seen most clearly in FIGS. 4*a* and 4*b*, a biasing spring 66 is placed at the interior of body 60 to automatically urge extension piece 61 into its deployed position in which the major part of extension piece 61 is located outside of body 60, as particularly shown in FIG. 4*a*.

Extension piece 61 is retained in this position by an end of travel abutment, formed by a shoulder 61A disposed at the end of extension piece 61, cooperating with a collar, or neck, 60A formed at the end of body 60.

Body 60 of device 6 also has a locking system permitting extension piece 61 to be immobilized, or locked, or latched, in a retracted position in which the major part of extension piece 61 is located within body 60, as shown most clearly in FIG. 4*b*.

The locking system is constituted by a latch 67A carried by a button 67 mounted for pivotal movement about a pivot axis 68 carried by body 60. Button 67 is biased by a spring 69 toward a rest position in which latch 67A projects into body 60 and cooperates with shoulder 61A of extension piece 61 in order to retain extension piece 61 in the rest position. Latch 67A is carried by the part of button 67 that is closer to pivot element 62, while spring 69 is located at the opposite side of button 67 with respect to pivot axis 68. Thus, in order to unlatch extension piece 61, it is sufficient for the user to rock button 67 against the action of spring 69 in a manner to displace latch 67A away from shoulder 61A. This allows extension piece to automatically move to its deployed position by the action of spring 66. In an advantageous manner, the resulting cord guide device can be dimensioned to guide the cord over a length portion of between 60 and 120 mm.

Such a cord guide device presents the advantage of simplifying storage of the iron as a result of the reduced amount of space occupied by cord guide device 6 when extension piece 61 is in the retracted, or folded up, position, cord guide device 6 being able to be positioned vertically in notch 7, and cord 3 can then be wound around casing 1 as illustrated in FIG. 1.

Conversely, for utilization of the iron, extension piece 61 can be deployed in order to increase the effective length of guidance of cord 3, which permits cord 3 to be extended from the rear of the iron and to particularly prevent cord 3 from rubbing against the edge of the ironing board or against the fabric being ironed.

Figure 5:
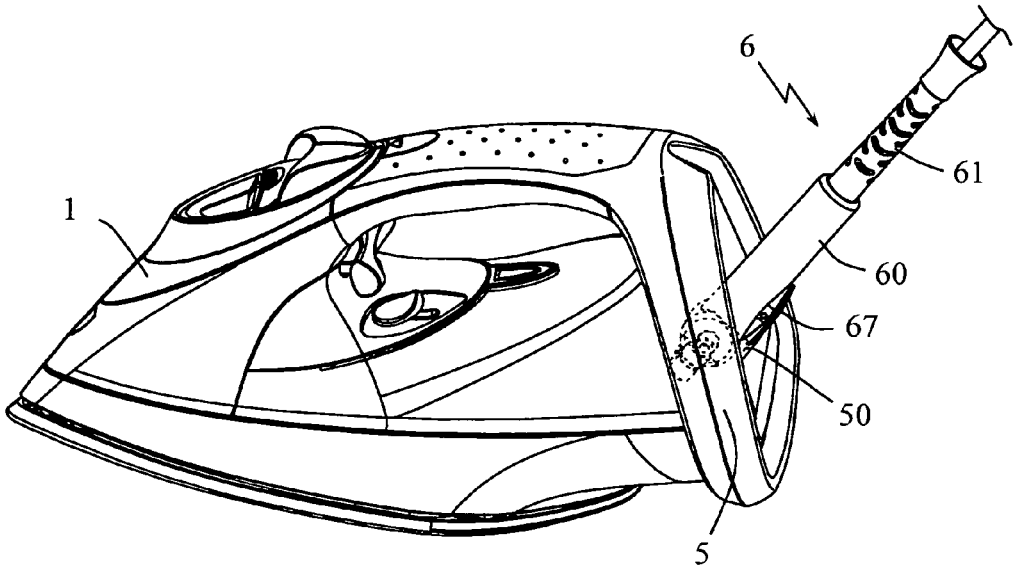
FIG. 5 is a perspective view of a pressing iron having a cord guide device according to a second embodiment of the invention, in its deployed position.
Figure 7A:
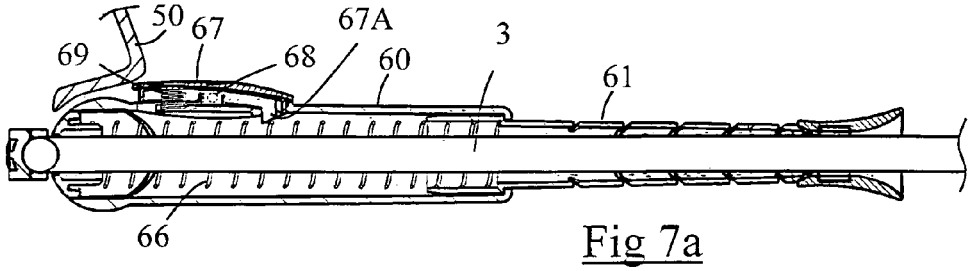
FIGS. 7*a* and 7*b* are cross-sectional views, taken along the line VII-VII of FIG. 6, of the device of FIG. 5 in respective ones of an extended position and a retracted position.
Figure 7B:
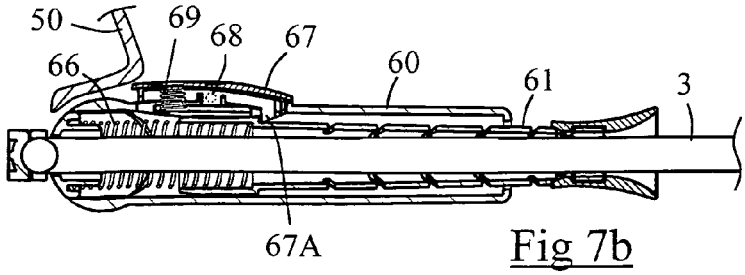

FIGS. 5-7 show another embodiment of the invention in which button 67 is close to the axis of pivot elements 62 and in which spring 69 of latch 67A have their positions reversed with respect to pivot axis 68 of the button in such a manner that spring 69 is located between button 67 and pivot element 62 and button 67 can be actuated automatically by coming to abut against a wall 50 extending between the two arms 5 when cord guide device 6 is rocked toward the rear of the iron, for example through an angle of more than about 45° from the vertical position.

This second embodiment presents the advantage of assuring an automatic deployment of the extension piece when tension is applied on cord 3 in the direction to rock cord guide device 6 toward the rear. Thus, if the user forgets to manually deploy extension piece 61 before starting an ironing session, the extension piece will deploy automatically the first time the cord is pulled toward the rear during the ironing session. This serves to prevent cord 3 from experiencing a premature failure which could occur in the part of the cord that extends from the housing if ironing were performed with the extension piece retracted, because of the substantial rigidity of body 60 of cord guide device 6 and of the short length of the flexible guidance of the cord when extension piece 61 is in the retracted position.

This application relates to subject matter disclosed in French Application number FR 05 09546, filed on Jan. 19, 2005, the disclosure of which is incorporated herein by reference.

While the description above refers to particular embodiments of the present invention, it will be understood that many modifications may be made without departing from the spirit thereof. The accompanying claims are intended to cover such modifications as would fall within the true scope and spirit of the present invention.

The presently disclosed embodiments are therefore to be considered in all respects as illustrative and not restrictive, the scope of the invention being indicated by the appended claims, rather than the foregoing description, and all changes which come within the meaning and range of equivalency of the claims are therefore intended to be embraced therein.

What is claimed is:

1. A pressing iron comprising: a case provided with an opening and a power cord that extends from said opening; and a cord guide device mounted to said case and disposed in said opening for reinforcing said cord in a region adjacent to said case in order to limit flexure of said cord, wherein said cord guide device comprises: a body enveloping a portion of said cord; and mobile guide means for permitting the extent of said cord that is reinforced by said cord guide device to be varied, and further wherein said mobile guide means are supported by said body and are adapted to occupy a folded up position in which said mobile guide means are substantially retracted into said body and a deployed position in which said mobile guide means project outside of said body.

2. The pressing iron according to claim 1, further comprising spring means coupled to said mobile guide means for urging said mobile guide means into the deployed position.

3. The pressing iron according to claim 2, wherein said cord guide device further comprises locking means coupled to said mobile guide means for maintaining said mobile guide means in the folded up position, and an unlocking button coupled to said locking means and actuatable to move said locking means to an unlocking position.

4. The pressing iron according to claim 3, wherein said body of said cord guide device is pivotally mounted on said case and said unlocking button is adapted to be actuated automatically when said body is rocked in a direction away from said case.

5. The pressing iron according to claim 4, wherein said mobile guide means are flexible.

6. The pressing iron according to claim 5, wherein said body of said cord guide device is more rigid than said mobile guide means.

7. The pressing iron according to claim 6, wherein said mobile guide means are movable in translation with respect to said body of said cord guide device.

8. The pressing iron according to claim 7, wherein said mobile guide means are constituted by an extension piece that is displaceable in said body of said cord guide device so that said cord guide device has a telescopic form.

9. The pressing iron according to claim 8, wherein said body of said cord guide device and said extension piece are slightly conical.

10. The pressing iron according to any claim 9, wherein said cord is an electric power cord of said iron.

11. The pressing iron according to claim 1, wherein said mobile guide means are flexible.

12. The pressing iron according to claim 11, wherein said body of said cord guide device is more rigid than said mobile guide means.

13. The pressing iron according to claim 12, wherein said mobile guide means are movable in translation with respect to said body of said cord guide device.

14. The pressing iron according to claim 13, wherein said mobile guide means are constituted by an extension piece that is displaceable in said body of said cord guide device so that said cord guide device has a telescopic form.

15. The pressing iron according to claim 14, wherein said body of said cord guide device and said extension piece are slightly conical.

16. The pressing iron according to any claim 1, wherein said cord is an electric power cord of said iron.

* * * * *